US008891807B2

(12) United States Patent
Gleiβner et al.

(10) Patent No.: US 8,891,807 B2
(45) Date of Patent: Nov. 18, 2014

(54) LOUDSPEAKER APPARATUS WITH LIGHT SOURCE AND COOLING DEVICE

(75) Inventors: Achim Gleiβner, Barienrode/Diekholzen (DE); Jörg Knieschewski, Garbsen (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 13/990,131

(22) PCT Filed: Nov. 29, 2011

(86) PCT No.: PCT/EP2011/071258

§ 371 (c)(1), (2), (4) Date: Jun. 6, 2013

(87) PCT Pub. No.: WO2012/072622

PCT Pub. Date: Jun. 7, 2012

(65) Prior Publication Data

US 2013/0294639 A1 Nov. 7, 2013

(30) Foreign Application Priority Data

Dec. 1, 2010 (DE) ..... 10 2010 062 300

(51) Int. Cl.

| | |
|---|---|
| ***H04R 1/00*** | (2006.01) |
| ***H04R 1/02*** | (2006.01) |
| ***H04R 9/02*** | (2006.01) |

(52) U.S. Cl.

CPC ..... *H04R 1/00* (2013.01); *H04R 1/028* (2013.01); *H04R 9/022* (2013.01)

USPC ..... 381/397; 381/164

(58) Field of Classification Search

CPC ..... H04R 9/022; F21V 33/0056

USPC ..... 381/397, 164, 396

See application file for complete search history.

(56) References Cited

U.S. PATENT DOCUMENTS

| | | | |
|---|---|---|---|
| 6,443,586 | B1 | 9/2002 | Azima et al. |
| 6,978,030 | B2 | 12/2005 | Reich |

(Continued)

FOREIGN PATENT DOCUMENTS

| | | |
|---|---|---|
| DE | 199 62 837 | 7/2001 |
| DE | 10 2004 006 724 | 9/2005 |

(Continued)

OTHER PUBLICATIONS

Machine Tanslation of German Publication 102009021144, Gleisner, Nov. 18, 2010.*

International Search Report for Application No. PCT/EP2011/071258 dated Feb. 22, 2012.

*Primary Examiner* — Ahmad F Matar

*Assistant Examiner* — Katherine Faley

(74) *Attorney, Agent, or Firm* — Frommer Lawrence & Haug LLP

(57) ABSTRACT

There is provided a loudspeaker apparatus which has a diaphragm and a magnet system for driving the diaphragm. The loudspeaker apparatus also has a light source and a cooling device (K) having at least one cooling unit for cooling the at least one light source. The light source is thermally coupled to the first cooling unit. The first cooling unit with the at least one light source is arranged in front of the diaphragm. The outside of the diaphragm can have light reflecting properties.

8 Claims, 2 Drawing Sheets

(56) References Cited

U.S. PATENT DOCUMENTS

| | | | | |
|---|---|---|---|---|
| 7,123,738 | B1 | 10/2006 | Mizone et al. | |
| 2007/0003100 | A1 | 1/2007 | Liu | |
| 2007/0222631 | A1 | 9/2007 | Haase | |
| 2008/0225510 | A1 | 9/2008 | Rocha | |
| 2009/0027883 | A1 * | 1/2009 | Koike et al. | 362/235 |
| 2010/0039355 | A1 | 2/2010 | Park | |

FOREIGN PATENT DOCUMENTS

| | | |
|---|---|---|
| DE | 10 2009 021 144 | 11/2010 |
| EP | 1 838 132 | 9/2007 |
| WO | WO 88/05685 | 8/1988 |

* cited by examiner

LOUDSPEAKER APPARATUS WITH LIGHT SOURCE AND COOLING DEVICE

The present application claims priority from PCT Patent Application No. PCT/EP2011/071258 filed on Nov. 29, 2011, which claims priority from German Patent Application No. DE 10 2010 062 300.8 filed on Dec. 1, 2010, the disclosures of which are incorporated herein by reference in their entirety.

FIELD OF THE INVENTION

The present invention concerns a loudspeaker apparatus.

It is noted that citation or identification of any document in this application is not an admission that such document is available as prior art to the present invention.

Loudspeaker systems are known both for example in the form of ceiling loudspeakers and also lighting systems which are arranged at or in the ceiling.

U.S. Pat. No. 6,978,030 B2 discloses a loudspeaker with a cover in which light emitting units can be provided. The light emitting units can be controlled in dependence on the audio signal reproduced by the loudspeaker.

U.S. Pat. No. 6,443,586 B1 discloses an areal loudspeaker with a light tube arranged in the lower region of the loudspeaker. The light tube serves to illuminate a front covet US No 2007/0003100 discloses a loudspeaker with a light emitting diode which illuminates the diaphragm of the loudspeaker from behind.

WO 88/05685 A1 discloses an apparatus for producing light effects. That apparatus has a loudspeaker with a diaphragm and light sources. In that case the light sources are provided in front of the diaphragm. In addition rotating apertured disks are provided above the diaphragm. The rotary movement of the rotating apertured disks provides for alternate coverage of the holes in the two apertured disks, and that leads to the desired light effects. A rotary movement of the apertured disks is produced by the vibrations occurring in operation of the loudspeaker.

EP 1 838 132 A1 discloses a loudspeaker having a light emitting diode in the region between the diaphragm and a basket of the loudspeaker.

US No 2008/0225510 A1 discloses a loudspeaker having a fluorescent tube behind a diaphragm.

U.S. Pat. No. 7,123,738 B1 discloses a loudspeaker having a diaphragm and light emitting diodes arranged in front of the diaphragm.

DE 199 62 837 A1 discloses a lighting body having a plurality of loudspeakers, wherein light sources are arranged in front of a diaphragm of the loudspeakers.

DE 10 2004 006 724 A1 discloses a loudspeaker apparatus with a plurality of diaphragms and a plurality of light sources arranged behind the diaphragm.

DE 10 2009 021 144 A1 discloses a loudspeaker apparatus having a diaphragm, a magnet system for driving the diaphragm and at least one light source arranged in front of the diaphragm. The diaphragm can have a light reflecting layer so that the light of the light source is reflected.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112, first paragraph) or the EPO (Article 83 of the EPC), such that applicant(s) reserve the right to disclaim, and hereby disclose a disclaimer of, any previously described product, method of making the product, or process of using the product.

SUMMARY OF THE INVENTION

An object of the present invention is to provide a loudspeaker apparatus which permits a suitable combination of a loudspeaker with a lighting unit and affords various instillation options.

That object is attained by a loudspeaker apparatus as set forth in claim 1.

Thus there is provided a loudspeaker apparatus which has a diaphragm and a magnet system for driving the diaphragm. The loudspeaker apparatus also has a light source and a cooling device having at least one cooling unit for cooling the at least one light source. The light source is thermally coupled to the first cooling unit. The first cooling unit with the at least one light source is arranged in front of the diaphragm. The outside of the diaphragm can have light reflecting properties.

Thus there can be provided an apparatus which serves both for lighting and also for producing sound in a room and which has adequate cooling of the light source. Thus it is only necessary to install one apparatus to achieve both.

In an aspect of the present invention the diaphragm is of such a configuration that it has an optical focal point, the light source being arranged in that focal point.

In an aspect of the invention the light source has a hemispherical radiation characteristic in the direction of the diaphragm. Thus the light is only reflected into the room by the light reflecting diaphragm, that is to say there is no direct irradiation of the light source into the room.

In a further aspect of the invention the position of the light source is adjustable along the longitudinal axis of the loudspeaker apparatus. It is possible to influence the lighting of a room by adjustment of the position of the light source.

In a further aspect of the invention the loudspeaker apparatus has a basket and/or a dust protection dome which is of a concave configuration.

In a further aspect of the invention there is provided a cable feed for the light source through the magnet system.

In a further aspect of the invention the light sources are in the form of light emitting diodes.

In an aspect of the invention the external housing is of an at least partially translucent nature.

In an aspect of the invention there is provided a grill in the region of the front side of the loudspeaker apparatus. The grill is at least partially sound-transmitting and/or translucent.

In a further aspect of the invention there is provided an input, wherein the power supply for the light sources and the input signal for the magnet system are received by way of the input.

In a further aspect of the invention there is provided a high pass filter in the signal path for the magnet system in order to provide there for dc voltage separation.

The invention also concerns a loudspeaker apparatus having a diaphragm at least partially of a material which can light up, a magnet system for driving the diaphragm and a basket provided between the magnet system and an outer end of the diaphragm.

The invention is based on the concept of providing a loudspeaker apparatus which has a lighting unit, wherein elements of the loudspeaker apparatus are used by the lighting unit for optical purposes. In this case for example a diaphragm of the loudspeaker can be used as a reflector for the lighting unit. In that way optical and acoustic elements of the loudspeaker apparatus can be combined, that is to say an acoustic element can also represent optical functions (for example reflector, diffuser).

DETAILED DESCRIPTION OF EMBODIMENTS

It is to be understood that the figures and descriptions of the present invention have been simplified to illustrate elements that are relevant for a cleat understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
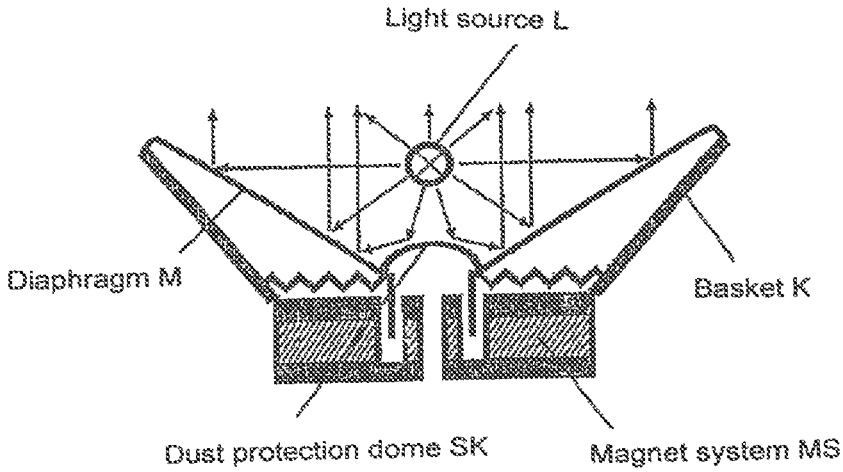
Fig. 1 (prior art)
FIG. 1 shows a diagrammatic sectional view of a loudspeaker apparatus according to the state of the art.

FIG. 1 shows a diagrammatic view of a loudspeaker apparatus according to the state of the art. The apparatus has a diaphragm M, a magnet system MS for driving the diaphragm M, a basket K, optionally a dust protection dome SK and at least one light source L. At its outside the diaphragm M can have light reflecting properties or alternatively can have a light reflecting coating. A corresponding consideration applies to the outside of the dust protection dome SK. Thus the light of the light source can be reflected by the diaphragm M. The specific configuration of the diaphragm M can provide that the light of the light source is reflected in focused condition.

Thus the diaphragm required for the electroacoustic reproduction transducer can also be used as a reflector for the light source.

Figure 2:
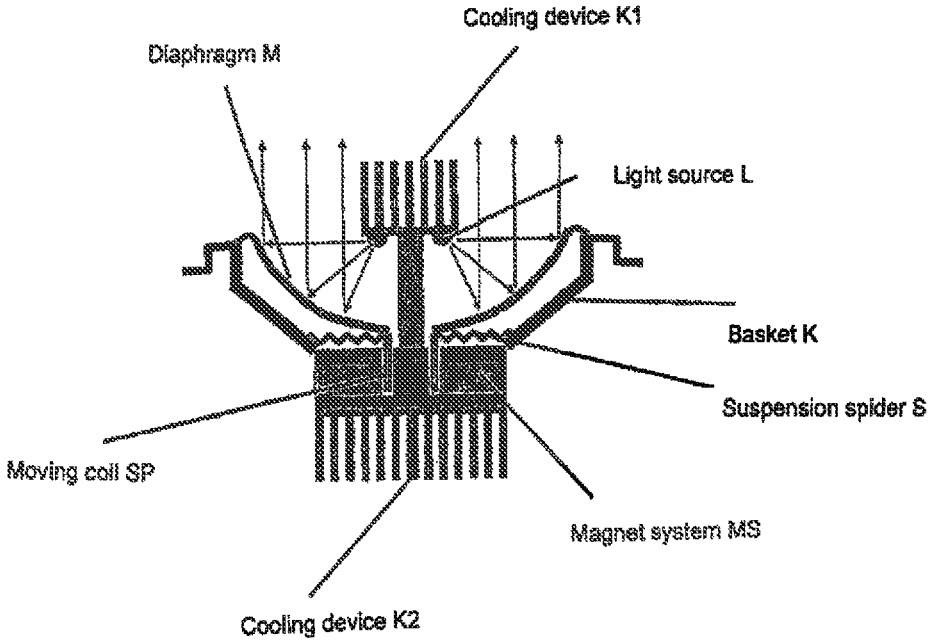
FIG. 2 shows a diagrammatic sectional view of a loudspeaker apparatus according to a first embodiment.

FIG. 2 shows a diagrammatic sectional view of a loudspeaker apparatus according to a first embodiment. The loudspeaker apparatus has a diaphragm M, a magnet system MS for driving the diaphragm M, a basket K, at least one light source L, optionally a suspension spider S and a cooling device K. The magnet system can have a moving coil SP. At its outside the diaphragm M can have light reflecting properties or alternatively can have a light reflecting coating or layer. The cooling device K has a first cooling unit K1 in front of the diaphragm and optionally a second cooling unit K2 behind the diaphragm. The at least one light source L can be provided at the first cooling unit K1 so that the heat generated by the at least one light source L can be given off by way of the first cooling unit K.

The first and second cooling units K1, K2 are optionally thermally connected together so that the heat absorbed by the first cooling unit K1 from the at least one light source can be partially passed by way of the thermal coupling to the second cooling unit K2 so that the latter can give off heat to the environment. It will be appreciated that the first cooling unit Ki will also already give off heat to the ambient air.

Preferably the first and/or second cooling unit K1, K2 has a plurality of cooling ribs for increasing the cooling surface area.

Alternatively or additionally to cooling ribs at the second cooling unit K2 the second cooling unit K2 can also be provided with a fan to give off to the environment the heat passed from the first cooling unit by way of the thermal coupling to the second cooling unit K2.

In the first embodiment the light sources L are in the form of light emitting diodes LEDs.

To permit efficient delivery of the heat to the ambient air the first and/or second cooling unit K1, K2 has a large surface area. That can be implemented for example by the provision of cooling ribs.

If the loudspeaker apparatus of the first embodiment is to be fitted in a ceiling then the heat generated by the light sources L is passed by way of the first cooling unit K1 through the thermal coupling to the second cooling unit K2 arranged above the first cooling unit K1. In that way natural thermal convection upwardly can be taken into consideration.

In the first embodiment the first and/or second cooling unit K1, K2 can be thermally coupled to the magnet system. The provision of the second cooling unit K2 means that the heat-dissipating surface of the magnet system can be artificially increased.

The first cooling unit K1 has a plurality of cooling ribs which face away from the diaphragm. The at least one light source can be provided on the rear side of the cooling ribs so that the light emitted thereby is incident directly on the diaphragm M and is reflected by the diaphragm. The at least one light source L can in that case preferably be provided in the focal point of the diaphragm. In other words the cooling unit K1 is also arranged substantially in the focal point of the diaphragm M.

In a second embodiment the loudspeaker apparatus substantially corresponds to the loudspeaker apparatus of the first embodiment, in which respect it is only that the light source is provided not in front of the diaphragm M but in the intermediate region between the diaphragm M and the basket K. In the second embodiment the diaphragm is transparent or partly transparent so that the light of the light source L can be irradiated through the diaphragm. Optionally the inside of the basket K can be provided with a reflecting layer or the inside of the basket K can have light reflecting properties.

Thus the light source can be arranged behind the diaphragm for example on or in the region of the basket In that case the diaphragm and optionally the dust protection dome are transparent. The diaphragm can also have an optically diffusing effect in order for example to scatter the light more uniformly. The basket can optionally be used for cooling for the light source. The light sources according to the invention can be for example light emitting diodes (LEDs).

In the second embodiment the at least one light source L can be provided between the basket and the diaphragm and can be fixed on a cooling device, wherein the cooling device has a cooling unit thermally connected to the magnet system and having an enlarged surface area to be able to give off more heat to the ambient air. In the second embodiment therefore it is possible to dispense with the first cooling K1 in front of the diaphragm. The first cooling unit can then be provided between basket and diaphragm or it is possible to dispense completely with the first cooling unit as the light sources are thermally coupled to the second cooling unit.

A loudspeaker apparatus according to a third embodiment has a magnet system MS, a basket K, a diaphragm M, a dust protection dome SK and a light source L. The apparatus further has an external housing G, the light source L being arranged behind the magnet system MS. The inside surface of the external housing G can have light reflecting properties or it can have a light reflecting layer. Thus the light emitted by the light source L can be reflected at the inside surface of the external housing G in such a way that it is irradiated forwardly in substantially focused condition. For that purpose the basket K and the diaphragm M can be transparent or partly transparent.

Thus the light source can be arranged behind the magnet system and the light can be reflected forwardly through the light reflecting inside of the external housing. in this arrangement the diaphragm is at least partially optically transparent. Optionally the basket can also be at least partially transparent. The diaphragm and/or the basket can have an optically diffusing effect in order for example to be able to better scatter the light Optionally the light of the light source can be passed forwardly by way of a light guide. A part of the light can optionally be irradiated rearwardly in order in that way to light up a rearward surroundings.

The loudspeaker apparatus of the third embodiment can have a cooling device as described in the first embodiment, wherein the dust protection dome is then replaced by the cooling device.

In the third embodiment of the invention the cooling device K can be provided with a cooling unit K2, the cooling unit K2 being thermally coupled to the magnet system. In that case the light source is provided directly on the cooling unit K2 and the cooling unit K2 serves to dissipate the heat generated by the light source L.

A loudspeaker apparatus according to a fourth embodiment has a magnet system MS, a basket K, a diaphragm M and a dust protection dome SK. The apparatus further has in the region of the basket a light source L and a grill GI in front of a first end of the apparatus. The diaphragm M has light reflecting properties or a light reflecting layer. Thus the light emitted by the light source can be reflected at the diaphragm in such a way that it can issue through the grill GI. In that arrangement the grill GI can optionally be so arranged that only light beams emitted parallel to the grill surfaces are passed therethrough.

The grill of the fourth embodiment of the invention is preferably sound-transmissive and/or at least partially translucent. The grill can have a light guiding and/or diffusing action. For example the grill structure can be of an at least partially mirrored or light reflecting nature.

The loudspeaker apparatus of the fourth embodiment can have a cooling device as described in the first embodiment, in which case the dust protection dome is then replaced by the cooling device.

In the fourth embodiment the grill GI can optionally be thermally coupled to the first and/or second cooling unit K1, K2 in order to be able to give off the heat generated by the light source L to the ambient air.

A loudspeaker apparatus according to the fifth embodiment has an external housing AG and three apparatuses according to the invention. Each of the apparatuses has a magnet system MS, a basket K and a diaphragm M. A respective light source L is provided in the region of the diaphragm M. The outside of the diaphragm M can have light reflecting properties or a light reflecting layer. In the third embodiment therefore there can be a plurality of systems in a common external housing.

The loudspeaker apparatus of the fifth embodiment can have a cooling device as described in accordance with the first embodiment, in which case then the dust protection dome is replaced by the cooling device. The second cooling unit in accordance with the fifth embodiment can also be continuous or interrupted between the loudspeaker apparatuses.

A loudspeaker apparatus according to the sixth embodiment has a magnet system MS, a basket K, a diaphragm M, a light source L and optionally a protective dome SK. In addition there is a light source L in the region of the diaphragm. The outside of the diaphragm can have light reflecting properties or a light reflecting layer. In addition there are provided the electric connections for the electroacoustic reproduction transducer and for the current or voltage supply for the light source. Preferably there can be provided a common connection E both for actuation of the light source L and also for actuation of the diaphragm M. A high pass filter HP can be provided in the signal path for the input signal of the electroacoustic transducer to filter out signals which are above a given limit frequency.

The apparatus according to the invention is advantageous because there are fewer components to be installed as the lighting unit and the sound production unit are implemented in a common apparatus. In this case the optical elements can use at least partially acoustic elements for example as reflectors. The apparatus according to the invention is also advantageous because the installation complication and expenditure for the lighting and sound producing units is considerably reduced as it is only a single unit that has to be installed. In addition the reduced number of units to be installed makes it possible to achieve a considerable improvement in aesthetic impression. The loudspeakers required for the sound producing devices can be 'concealed' in this case in the lighting devices.

The loudspeaker apparatus of the sixth embodiment can have a cooling device as described in the first embodiment. For that purpose the dust protection dome SK can then be replaced by the cooling device.

According to the invention elements of the sound producing or reproduction unit can be used as elements for the lighting unit. Such elements can be for example the diaphragm, the basket, a reflector, a diffuser or the like. In an embodiment of the invention the light source is arranged in front of the diaphragm, the diaphragm and optionally the dust protection dome having light emitting properties. Thus the diaphragm can act as a reflector for the light source. Optionally the light source can have a hemispherical radiation characteristic and emit only in the direction of the reflector. Optionally the diaphragm can have an optical focal point, the light source being arranged in that focal point. In addition the position of the light source can optionally be adjustable along the longitudinal axis of the apparatus so that the light irradiation angle is adjustable. The dust protection dome can optionally be concave.

The apparatus according to the invention can be for example mounted in a flat configuration in or at a room ceiling or wall.

In a further aspect of the present invention the light reflecting elements can be provided in the form of areal or flat components, for example in the form of surface radiating devices having an optically active surface.

In a further embodiment of the invention multi-colored light sources can be used in a unit. The above-described light source L can be implemented in the form of one or more light sources for example of differing colors. The respective lighting units can be actuated separately.

In a further embodiment of the invention the power supply for the light sources and the signal feed for the electroacoustic sound transducer can be implemented by way of the same electric contacting means. That can be effected for example in the form as the same direct current offset on the signal line with additional dc voltage separation by way of a high pass filter.

In an embodiment of the invention a high pass filter can be provided at the input of the sound transducer to prevent flickering due to the movement of the diaphragm being perceptible to a human eye.

In a further embodiment of the invention which can be based on one of the preceding embodiments the basket at its inside has a light emitting material or a material which can light up such as for example an OLED film (organic light emitting device) as the light source. In that case there is no need for a separate light source.

In a further aspect of the invention which can be based on one of the preceding embodiments the diaphragm is (at least partially) in the form of light emitting material or material which can light up. In that case the diaphragm can have an OLED film. A cable feed for that OLED can be effected through the magnet system of the loudspeaker apparatus. In that case there is no need for a separate light source.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A loudspeaker apparatus comprising:
a diaphragm;
a magnet system configured to drive the diaphragm;
at least one light source; and
a cooling device having at least one First cooling unit configured to cool the at least one light source;
wherein die at least one light source is thermally coupled to the at least one first cooling unit;
wherein an outside of the diaphragm has a light reflecting layer or light reflecting properties so as to reflect the light of the at least one light source;
wherein the at least one light source is arranged in front of the diaphragm;
wherein the diaphragm is configured to have an optical focal point, with the at least one light source being arranged in the optical focal point of the diaphragm;
wherein the diaphragm comprises an opening in a center of the diaphragm;
wherein the at least one light source is thermally coupled, through the opening in the diaphragm, to the first cooling unit which is arranged behind the diaphragm; and
wherein the at least one first cooling unit has a plurality of cooling ribs which face away from the diaphragm.

2. The loudspeaker apparatus as set forth in claim 1;
wherein the at least one light source has a hemispherical radiation characteristic which is in a direction of the diaphragm.

3. The loudspeaker apparatus as set forth in claim 1, further comprising:
a cable feed for the at least one light source, which is effected through the magnet system.

4. The loudspeaker apparatus as set forth in claim 1;
wherein the at least one light source is in the form of a light emitting diode.

5. The loudspeaker apparatus as set forth in claim 1, further comprising:
a cable feed which is effected through the magnet system, and is configured to supply the diaphragm with material configured to light up with energy;
wherein the diaphragm at least partially comprises an organic light-emitting device ("OLED") film.

6. The loudspeaker apparatus as set forth in claim 1;
wherein the at least one light source is adapted to emit multi-colored light.

7. A loudspeaker system comprising:
a loudspeaker apparatus comprising:
a diaphragm;
a magnet system configured to drive the diaphragm;
at least one light source; and
a cooling device having at least one first cooling unit configured to cool the at least one light source;
wherein the at least one light source is thermally coupled to the at least one first cooling unit;
wherein an outside of the diaphragm has a light reflecting layer or light reflecting properties so as to reflect the light of the at least one light source;
wherein the at least one light source is arranged in front of the diaphragm;
wherein the diaphragm is configured to have an optical focal point, with the at least one light source being arranged in the optical focal point of the diaphragm;
wherein the diaphragm comprises an opening in a center of the diaphragm;
wherein the at least one light source is thermally coupled, through the opening in the diaphragm, to the first cooling unit which is arranged behind the diaphragm; and
wherein the at least one first cooling unit has a plurality of cooling ribs which face away from the diaphragm.

8. The loudspeaker system as set forth in claim 7, further comprising:
a plurality of the loudspeaker apparatuses; and
a housing which houses the plurality of the loudspeaker apparatuses.

* * * * *